United States Patent [19]

Doi et al.

[11] 4,132,036

[45] Jan. 2, 1979

[54] ADJUSTING STRUCTURE IN AN ASPHERIC LENS GRINDING APPARATUS

[75] Inventors: Yuzuru Doi, Niiza; Masanao Kawahara, Tsurugashima; Yasuyuki Tejima, Tokyo, all of Japan

[73] Assignee: Asahi Kogaku Kogyo Kabushiki Kaisha, Japan

[21] Appl. No.: 841,596

[22] Filed: Oct. 12, 1977

[30] Foreign Application Priority Data

Oct. 15, 1976 [JP] Japan ..... 51-122898

[51] Int. Cl.[2] ..... B24B 13/00

[52] U.S. Cl. ..... 51/124 L; 51/127

[58] Field of Search ..... 51/55, 124 R, 124 L, 51/127, 216 LP

[56] References Cited

U.S. PATENT DOCUMENTS

| | | | |
|---|---|---|---|
| 2,065,103 | 12/1936 | Simpson | 51/124 L |
| 2,747,339 | 5/1956 | Schelling | 51/124 L |
| 3,834,085 | 9/1974 | Moeller | 51/127 |

*Primary Examiner*—Nicholas P. Godici
*Attorney, Agent, or Firm*—Steinberg & Blake

[57] ABSTRACT

A lens grinding apparatus which is particularly suitable for grinding aspheric lenses has a rotary shaft which carries the lens which is to be ground and which is supported for rotation about the axis of the shaft by a support structure which has a support axis parallel to but spaced from the shaft axis. A mounting structure mounts the support structure on an oscillating structure which carries a template which determines the curvature of the lens surface which is ground and which has an oscillating axis around which the template is oscillated while the mounting structure, support structure and shaft supported thereby are all oscillated also about the oscillating axis. This oscillating axis is perpendicular to the shaft axis. By turning the support structure about its support axis with respect to the mounting structure it is possible to adjust the shaft axis so that it intersects the oscillating axis.

8 Claims, 7 Drawing Figures

ADJUSTING STRUCTURE IN AN ASPHERIC LENS GRINDING APPARATUS

BACKGROUND OF THE INVENTION

The present invention relates to lens grinding apparatus.

The present invention relates particularly to apparatus suitable for grinding aspheric lenses.

In conventional grinding apparatus of the above type the lens which is to be ground is carried by a rotary shaft while the surface which is to be ground is engaged by a grinding wheel. The rotary shaft which carries the lens which is to be ground is supported by an oscillating structure which oscillates about an oscillating axis and which carries a template which determines the curvature of the lens surface which is ground.

The axis of the shaft which carries the lens which is to be ground and the oscillating axis about which this shaft is oscillated together with the template are perpendicular to each other. In order to achieve a high accuracy in the grinding of a lens it is essential that the mutually perpendicular shaft axis and oscillating axis intersect each other.

In conventional structures of the above type the adjustments required for assuring intersection between these axes are carried out by relatively complex structures which are inconvenient to operate. Thus with conventional devices of this type the axis adjustment is carried out by using adjusting jigs and the like. These conventional structures are difficult to operate in such a way as to bring about the required adjustment with a high degree of accuracy. Quite often the mutually perpendicular axes of the shaft which carries the lens and the template which is oscillated together with this shaft, while initially intersecting each other, become displaced one with respect to the other, for example due to vibrations of the grinding apparatus, and it is extremely difficult with conventional apparatus to correct the position of these axes with respect to each other so that they intersect each other. Thus, when during operation of such a grinding apparatus the shaft axis and oscillating axis no longer intersect each other, it has proved to be practically impossible to achieve a rapid and accurate readjustment so as to bring the axis of the shaft and the oscillating axis again to a position where they intersect each other.

SUMMARY OF THE INVENTION

It is accordingly a primary object of the present invention to provide a structure which will solve the above problems.

In particular, it is an object of the present invention to provide a structure according to which it is possible conveniently and rapidly to adjust the above shaft axis and oscillating axis one with respect to the other so as to assure the intersection thereof.

Moreover, it is an object of the present invention to provide a construction according to which it becomes possible at any time during the grinding operation to terminate the operation, remove the shaft and the lens carried thereby so as to check the grinding of the lens, and then to return the shaft to an operating position where the axis of the shaft accurately intersects the oscillating axis about which the template is oscillated together with the shaft.

The structure of the invention conventionally includes a shaft means which carries the lens which is to be ground and which is supported by a support means for rotation about the shaft axis. This support means is itself mounted by way of a mounting means on an oscillating means which oscillates about an oscillating axis perpendicular to the shaft axis, this oscillating means carrying a template which determines the curvature of the lens surface which is ground. The template is traced by a tracing means which through a transmission means moves a grinding means which has a grinding wheel in engagement with the surface of the lens which is to be ground. The tracing means moves in response to its engagement with the oscillating template and the transmission means provides for the grinding means, which has a grinding axis parallel to the shaft axis, a movement along the grinding axis which has a predetermined fractional relationship with respect to the movement of the tracing means in response to oscillation of the template. Thus, the shaft axis as well as the grinding axis are perpendicular to the oscillating axis and the shaft means together with its support means and the mounting means which carries the support means are all oscillated together with the oscillating means about the oscillating axis.

In accordance with the present invention, in order to bring the shaft axis and oscillating axis, which are perpendicular to each other, into a common plane where they intersect each other, the support means which supports the shaft means for rotation about its shaft axis itself has a support axis parallel to but spaced from the shaft axis. The mounting means mounts the support means for turning movement about its support axis so that the shaft is eccentrically mounted on the support means. Thus, by turning the support means about its support axis with respect to the mounting means it is possible to displace the shaft axis with respect to the oscillating axis until the shaft axis and oscillating axis intersect each other.

BRIEF DESCRIPTION OF DRAWINGS

The invention is illustrated by way of example in the accompanying drawings which form part of this application and in which.

DESCRIPTION OF A PREFERRED EMBODIMENT

Figure 1:
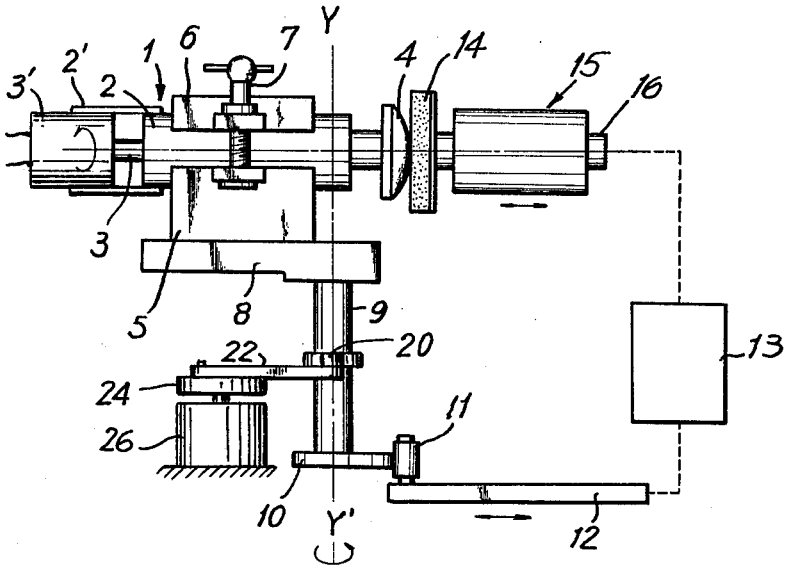
FIG. 1 is a schematic elevation of one possible embodiment of an apparatus according to the present invention.

Referring to FIG. 1, there is shown therein an assembly 1 which includes a support means 2 and a rotary shaft 3 supported for rotation by the support means 2.

The rotary shaft 3 extends through a bore formed in the support means 2. This shaft means 3 is driven by a motor 3' which is shown schematically in FIG. 1, connected by way of suitable brackets 2' to the support means 2 so as to be supported and carried thereby. The axis of the motor 3' coincides with the axis of the shaft means 3. Thus by way of the motor 3' it is possible to rotate the shaft means about its shaft axis which is parallel to but spaced from the axis of the support means 2, as will be apparent from the description which follows.

The shaft means 3 carries at its right end, as viewed in FIG. 1, the lens 4 which is to be ground. This lens 4 is carried by the shaft means 3 in any known way so as to rotate together with the shaft means 3.

A mounting means 5 is provided to mount the support means 2 on the oscillating means which includes the upright vertical shaft 9 and the arm 8 fixed to and projecting from the oscillating shaft 9 in the manner apparent from FIG. 1. The mounting means 5 is mounted on the arm 8 in such a way that the mounting means 5 can be shifted toward the right or left, as viewed in FIG. 1 while remaining in an adjusted position on the arm 8. Thus the mounting means 5 may, for example, have a lower portion of dovetail cross section received in a dovetail groove formed in the upper surface of the arm 8 so that the mounting means 5 can slide horizontally with respect to the arm 8, as viewed in FIG. 1, with any suitable structure being provided to fix the mounting means 5 in its position of adjustment along the arm 8.

Figure 1A:
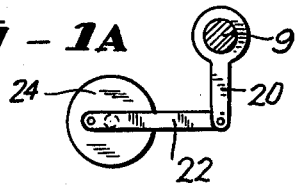
FIG. 1A is a schematic illustration of part of an oscillating means FIG. 1.

The vertical shaft 9 of the oscillating means is oscillated about its axis Y–Y', which thus forms the oscillating axis of the oscillating means, 8,9. As is shown schematically in FIG. 1A, it is possible, for example, to fix to the shaft 9 an arm 20 pivotally connected to a connecting rod 22 which in turn is eccentrically and pivotally connected to a rotary crank disk 24 driven by a motor 26 shown schematically in FIG. 1. Thus, through this structure the shaft 9 will be angularly oscillated back and forth about its oscillating axis Y–Y', and of course the arm 8 together with the mounting means 5 and the structure carried by the latter will oscillate about the oscillating axis Y–Y'.

The shaft 9 is supported in a suitable way for the oscillating about the axis Y–Y' and carries at its bottom end a template 10 in the form of a cam having a peripheral edge the configuration of which determines the curvature of the surface of the lens 4 which is ground. Thus this template 10 will, for example, serve to control the grinding operation so as to provide for the lens 4 an aspheric surface. A tracing means 11 includes a cam-follower roller which engages the peripheral camming or template surface of template 10, this tracing means 11 being maintained against the periphery of the template in any suitable way and being carried by an elongated rod 12 which is supported for movement to the right and left, as viewed in FIG. 1, so that in response to the curvature of the template 10 the rod 12 will be moved back and forth horizontally, as viewed in FIG. 1. This rod 12 is connected through the schematically illustrated transmission means 13 with a grinding means which includes the rotary grinding shaft 16 carrying the grinding wheel 14 which engages the surface of the lens 4 to grind the latter. The shaft 16 together with the grinding wheel 14 are driven by any suitable motor and the shaft 16 is supported by the bearing structure 15 in such a way that the shaft 16 is free to rotate about its axis together with the grinding wheel 14. This structure 15 is supported for movement to the right and left in response to operation of the transmission means 13. The transmission means 13 will in a well known manner provide for the grinding means 14–16 a horizontal movement which has a predetermined fractional relationship to the corresponding horizontal movement of the tracing means 11. For example, the template 10 may have a curve edge corresponding to the desired curvature of the lens 4 but being at a larger scale then the desired curvature for the lens 4. In this case the transmission means 13 will in a known way provide for the grinding means 14–16 the same horizontal movement as the tracing means 11 but a magnitude of such movement which is a fraction of the extent of movement of the tracing means 11. Thus as the latter moves to the right and left in response to actuation by the edge of the template 10 the grinding means will also move to the right and left but to a smaller extent.

The grinding surface of the grinding wheel 14 is of course in a plane normal to the axis the shaft 3. This plane of the grinding surface is also normal to the axis of the shaft 16. Thus the grinding axis which coincides with the axis of the shaft 16 and the shaft axis which coincides with the axis of the shaft 3 are parallel to each other both being normal to the plane of the grinding surface of the wheel 14, and of course the axes of the shafts 3 and 16 are spaced horizontally from each other, as is particularly apparent from FIG. 3. The oscillation of the assembly 1 about the oscillating axis Y–Y' enables the transmission 13 to provide by way of the grinding means 14-16 at the lens 4 a ground surface corresponding to the curvature determined by the template 10.

Figure 2:
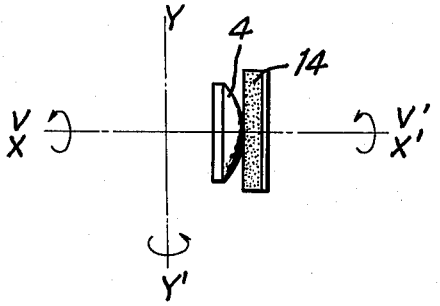
FIG. 2 is a schematic side elevation illustrating the shaft axis and oscillating axis, as well as the grinding axis and a grinding wheel and lens which is ground.
Figure 3:
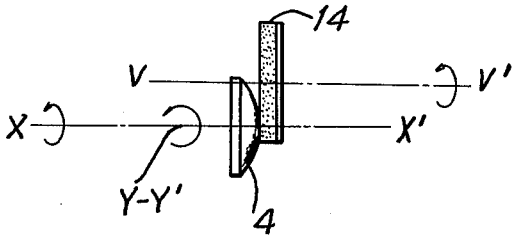
FIG. 3 is a top plan view showing also the axes of FIG. 2 as well as the grinding wheel and lens.

Referring now to the schematic side and plan views of FIGS. 2 and 3, it will be seen that the shaft axis X–X' of the shaft 3 must intersect and be perpendicular to the oscillating axis Y–Y' in order for the surface of the lens 4 to be properly ground by the grinding wheel 14 which rotates about the grinding axis V–V'. FIG. 3 shows the shaft axis X–X' in a position of zero angular displacement about the oscillating axis Y–Y' where the apex of the lens 4 is being worked by the grinding wheel 14. As is apparent from FIG. 3 any slight displacement of the axes X–X' and V–V' with respect to each other will have no effect on the operation as long as these axes are maintained parallel to each other. It is only critical that the axes X–X' and Y–Y' intersect each other at right angles.

Figure 4:
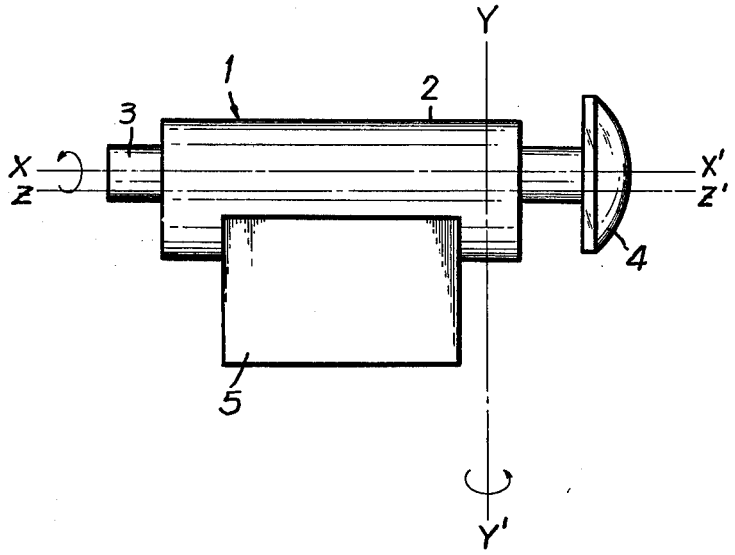
FIG. 4 is a schematic side elevation of the shaft means, support means and mounting means of the invention.
Figure 5:
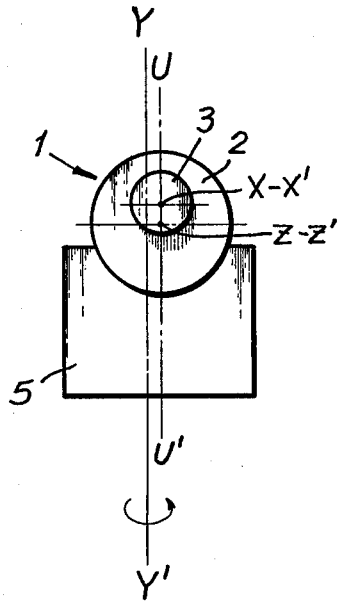
FIG. 5 is a schematic end view of the structure of FIG. 4 as seen from the left of FIG. 4 and showing the structure in a condition where the shaft axis is spaced from the oscillating axis.
Figure 6:
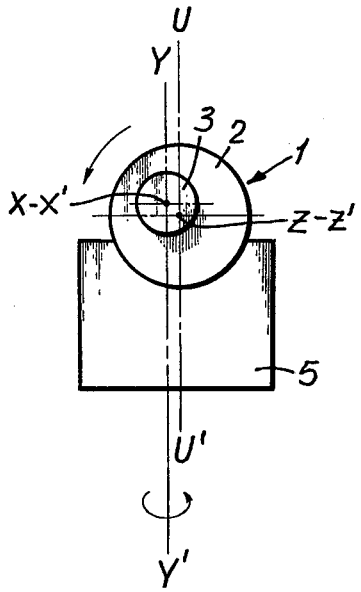
FIG. 6 shows the structure of FIG. 5 after it has been adjusted so as to bring the shaft axis to a position where it intersects the oscillating axis.

As is apparent particularly from FIGS. 4–6, the support means 2 is in the form of a cylindrical body having an exterior cylindrical surface which coincides with the support axis Z–Z' of the exterior cylindrical surface of the support means 2. The mounting means 5 has an upper concave surface of the same curvature as the exterior cylindrical surface of the support means 2 and the latter rests on this concave surface of the mounting means 5 so that the support means 2 can easily be turned about its support axis Z–Z'. This central support axis Z–Z' of the support means 2 is situated in the vertical plane U–U' indicated in FIGS. 5 and 6. Of course this latter vertical plane U–U' bisects the exterior cylindrical surface of the support means 2 as well as the upper groove of the mounting means 5 in which the support means 2 rests. On the other hand, it will be seen that the support means 2 is formed with an eccentric bore which receives the shaft means 3 so that the shaft axis X–X' of the shaft 3 is parallel to but spaced from the axis Z–Z' of the support means 2.

A releasable holding means is provided for releasably holding the support means 2 at a given adjusted position with respect to the mounting means 5. As shown in FIG. 1 this releasable holding means includes an upper plate 6 which engages the upper surface of the support means 2, this plate 6 having at its lower surface a groove which also forms part of the same cylinder as the exterior surface of the support means 2. This plate 6 has a pair of opposed ears formed with openings through which a pair of threaded members 7 pass, one of these members 7 being shown in FIG. 1 extending through the ear of the plate 6 and being threaded into a corresponding ear formed at the mounting means 5. The same structure is provided on the side of the support means 2 which is not visible in FIG. 1, so that by way of these threaded members 7 it is possible to releasably hold the support means 2 in a position of angular adjustment with respect to the mounting means 5.

Referring to FIG. 5, it can be assumed that the support means 2 has been placed in FIG. 5 in an arbitrary position on the mounting means 5. In this position the shaft axis X–X′ is spaced from the oscillating axis Y–Y′ so that even though the latter axes are perpendicular to each other they do not intersect. In order to bring about intersection of these axes it is only necessary to turn the support means 2 about its central axis Z–Z′ from the position of FIG. 5 into the position of FIG. 6. This will result in the displacement of the shaft axis X–X′ to the location shown in FIG. 6 where it intersects the oscillating axis Y–Y′. Now the releasable holding means 6,7 can be operated to releasably hold the support means 2 in its adjusted position. Thus a simple turning of the support means 2 in a counterclockwise direction from the position of FIG. 5 to the position of FIG. 6 will bring about the required adjustment. Of course the distance between the plane U–U′ and the axis Y–Y′ which is parallel to this plane, should not be greater than the distance between the axes X–X′ and Z–Z′.

Thus, as is apparent from the above description, it is a simple matter easily and quickly to adjust the position of the shaft axis X–X′ so that it intersects the oscillating axis Y–Y′. To effect this adjustment it is only necessary to turn the shaft axis X–X′ around the support axis Z–Z′. Thus, if it is desired to check on the progress of the grinding of the lens, or if it is desired simply to confirm the extent to which the lens surface has been worked, it is possible to release the releasable holding means 6,7 and remove the assembly 1 together with the lens so as to examine the latter. Thereafter the assembly 1 can quickly and easily be returned to its operative position simply by placing the support means 2 on the concave supporting surface of the mounting means 5. The angular position of the support means 2 on the mounting means 5 can easily be duplicated. For example before the assembly 1 is removed from the mounting means 5 suitable marks can be placed on the support means 2 and the mounting means 5 so that by bringing these marks again into alignment again it is possible to quickly duplicate the previous position of the support means 2 with respect to the mounting means 5.

Of course it is possible to use the apparatus of the invention together with other shafts and lenses as long as an adjusting structure according to the invention is utilized, so as to achieve in this way a greater efficiency in the machining of accurate aspheric lenses.

What is claimed is:

1. In a lens grinding apparatus which is particularly suited for grinding aspheric lenses and which includes an oscillating means for angularly oscillating about a given oscillating axis a template which determines the curvature of the ground surface of a lens, a rotary shaft means for carrying and rotating a lens which is to be ground and having a shaft axis perpendicular to the oscillating axis, a rotary grinding means for placing a grinding wheel in engagement with the lens surface which is to be ground and having a grinding axis parallel to the shaft axis, a tracing means for engaging the template and tracing the oscillatory movement thereof, a transmission means connected between the tracing means and grinding means for moving the grinding means along said grinding axis in response to movement of the tracing means by template with the movement of the grinding means along its axis having a given fractional relationship with respect to the extent of movement of the tracing means by the template, a support means supporting the shaft means for rotation about said shaft axis, and a mounting means mounting the support means on the oscillating means for movement therewith about the oscillating axis, so that while the lens which is to be ground is rotated about the shaft axis and engaged by the grinding wheel of the grinding means it is simultaneously oscillated about the oscillating axis, the improvement wherein the support means has a support axis parallel to but spaced from the shaft axis while the mounting means mounts the support means for adjustable turning movement about its support axis so that by turning the support means about its support axis with respect to said mounting means the shaft axis can be adjusted so as to have a location intersecting the oscillating axis.

2. The combination of claim 1 and wherein a releasable holding means is connected between the mounting means and support means for releasably holding the latter on said mounting means at a position where the shaft axis intersects the oscillating axis.

3. The combination of claim 1 and wherein said support means includes a cylindrical body having an exterior cylindrical surface coaxially surrounding said support axis and also surrounding said shaft means and said shaft axis thereof which is spaced from and parallel to said support axis, said mounting means including a body having a concave surface of the same curvature as said cylindrical surface of said support means and mounting the latter at said cylindrical surface thereof for turning movement about said support axis to displace said shaft axis with respect to said oscillating axis.

4. The combination of claim 3 and wherein said cylindrical body is formed with a bore the axis of which coincides with said shaft axis, and said shaft means extending coaxially through said bore of said cylindrical body to be supported by the latter for rotary movement about said shaft axis.

5. The combination of claim 4 and wherein a holding means is connected between said mounting means and support means for releasably holding the latter in an adjusted position with respect to said mounting means.

6. The combination of claim 1 and wherein said oscillating axis is vertical while said shaft, grinding, and support axes are all horizontal.

7. The combination of claim 6 and wherein said grinding axis is situated at substantially the same elevation as said shaft axis while being spaced therefrom.

8. The combination of claim 1 and wherein said mounting means is carried by said oscillating means at one side of said oscillating axis while said shaft means carries the lens which is to be ground at an opposite side of said oscillating axis.

* * * * *